US008464516B2

(12) United States Patent
Bell et al.

(10) Patent No.: US 8,464,516 B2
(45) Date of Patent: Jun. 18, 2013

(54) INLET FOR EXHAUST TREATMENT DEVICE

(75) Inventors: Charles Bell, Jackson, MI (US); Megan Wikaryasz, Ypsilanti, MI (US); Douglas Otrompke, Ypsilanti, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 314 days.

(21) Appl. No.: 12/948,974

(22) Filed: Nov. 18, 2010

(65) Prior Publication Data

US 2012/0124982 A1 May 24, 2012

(51) Int. Cl.
*F01N 3/00* (2006.01)

(52) U.S. Cl.
USPC ..... 60/286; 60/295; 60/299; 60/303

(58) Field of Classification Search
USPC ..... 60/286, 295, 299, 303
See application file for complete search history.

(56) References Cited

U.S. PATENT DOCUMENTS 4,531,363 A 7/1985 Ludecke et al.
4,604,868 A * 8/1986 Nomoto et al. ..... 60/286
4,651,524 A * 3/1987 Brighton ..... 60/274
5,417,059 A * 5/1995 Hartel et al. ..... 60/276
5,617,720 A * 4/1997 Achleitner et al. ..... 60/274
5,771,683 A * 6/1998 Webb ..... 60/286
5,826,428 A 10/1998 Blaschke
6,318,077 B1 11/2001 Claypole
7,513,921 B1 4/2009 Phelps et al.
7,610,752 B2 11/2009 Dalla Betta et al.
7,628,011 B2 12/2009 Crawley et al.
7,797,927 B2 9/2010 Nagaoka et al.
7,908,845 B2 * 3/2011 Brown et al. ..... 60/286
2007/0039315 A1 2/2007 Liang

* cited by examiner

*Primary Examiner* — Thomas Denion
*Assistant Examiner* — Diem Tran
(74) *Attorney, Agent, or Firm* — Harness, Dickey & Pierce, P.L.C.

(57) ABSTRACT

An exhaust gas treatment device includes an inlet housing having an inlet opening for receipt of an exhaust flow from an engine aligned along a first axis. A main housing includes a cylindrical body portion defining a treatment zone and an exhaust outlet aligned along a second axis extending parallel to the first axis. The inlet housing is in fluid communication with and fixed to an outer surface of the main housing. The inlet housing includes a contoured wall including an end portion positioned opposite the inlet opening, an aperture extending through the wall transverse to the first axis, divergent side wall portions on opposite sides of the inlet opening, and a necked portion having a reduced cross-section positioned downstream of the inlet opening and upstream of the aperture. A component is coupled to the main housing for treating exhaust flowing through the treatment zone.

18 Claims, 5 Drawing Sheets

INLET FOR EXHAUST TREATMENT DEVICE

FIELD

The present disclosure relates to an exhaust gas treatment system. More particularly, an inlet for an exhaust treatment device is configured to improve exhaust flow and reduce back pressure.

BACKGROUND

Reductions in the nitrogen oxides ($NO_x$) and particulate matter (PM) emitted from internal combustion engines continue to be of importance. In particular, increasingly stringent regulations relating to automotive diesel compression engines continue to be promulgated. While diesel particulate filters (DPF) are capable of achieving the required reductions in PM, there is a continuing need for improved systems that can provide the required reductions in $NO_x$, in connection with the PM reduction provided by a DPF.

Systems have been proposed to provide a diesel oxidation catalyst (DOC) upstream from a DPF in order to provide an increased level of $NO_2$ in the exhaust which reacts with the soot gathered in the DPF to produce a desired regeneration of the DPF. This method may be referred to as passive regeneration. Such systems, however, may have limited effectiveness at temperatures below 300° C. and typically produce a pressure drop across the oxidation catalyst that must be accounted for in the design of the rest of the system. Hydrogen or a hydrocarbon fuel may be delivered upstream of the DOC to generate temperatures greater than 600° F. and actively regenerate the DPF.

Some systems may include a burner to increase the temperature of the engine exhaust by igniting fuel and creating a flame that heats the exhaust to an elevated temperature that will allow for oxidation of particulate matter in a diesel particulate filter. Examples of such proposals are shown in commonly assigned and co-pending U.S. patent application Ser. No. 12/430,194, filed Apr. 27, 2009, entitled "Diesel Aftertreatment System" by Adam J. Kotrba et al., the entire disclosure of which is incorporated herein by reference.

While current burners for such systems may by suitable for their intended purpose, improvements may be desirable. For example, it may be advantageous to provide a burner having an exhaust gas inlet extending parallel to an exhaust gas outlet to reduce back pressure and alleviate component packaging and mounting concerns.

SUMMARY

This section provides a general summary of the disclosure, and is not a comprehensive disclosure of its full scope or all of its features.

An exhaust gas treatment device for treating an exhaust flow from an engine includes an inlet housing having an inlet opening for receipt of the exhaust flow from the engine aligned along a first axis. A main housing includes a cylindrical body portion defining a treatment zone and an exhaust outlet aligned along a second axis extending parallel to the first axis. The inlet housing is in fluid communication with and fixed to an outer surface of the main housing. The inlet housing includes a contoured wall including an end portion positioned opposite the inlet opening, an aperture extending through the wall transverse to the first axis, divergent side wall portions on opposite sides of the inlet opening, and a necked portion having a reduced cross-section positioned downstream of the inlet opening and upstream of the aperture.

A component is coupled to the main housing for treating exhaust flowing through the treatment zone.

Furthermore, an exhaust gas treatment device for treating an exhaust flow from an engine includes an inlet housing having an inlet opening for receipt of the exhaust flow from the engine with the inlet opening being aligned along a first axis. A main housing includes a cylindrical body portion defining a treatment zone and an exhaust outlet aligned along a second axis extending parallel to the first axis. The inlet housing is in fluid communication with and fixed to an outer surface of the main housing. The inlet housing includes a contoured wall including an end portion positioned opposite the inlet opening and an aperture extending through the wall transverse to the first axis. A portion of the contoured wall opposite the aperture includes a radially outwardly sloping portion intersecting a radially inwardly sloping portion at an inflection point. The inflection point is positioned axially downstream from the inlet opening and upstream from an upstream edge of the aperture to redirect the exhaust flow through the aperture. A component is coupled to the main housing for treating exhaust flowing through the treatment zone.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
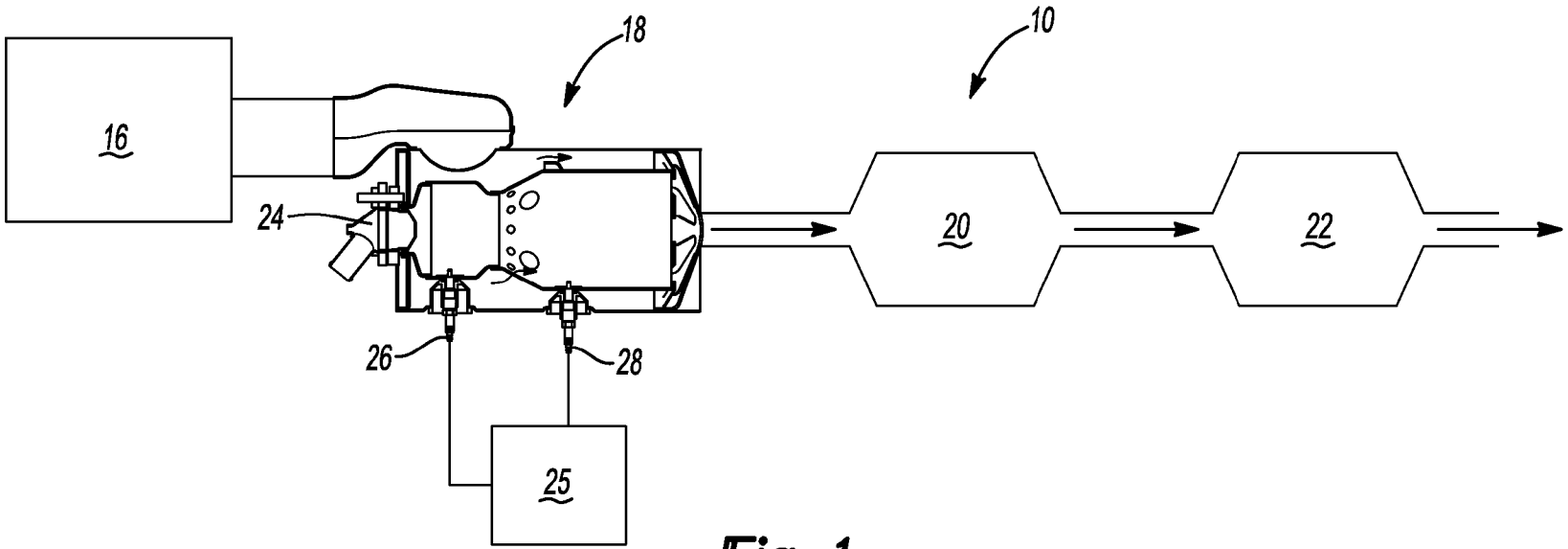
FIG. 1 is schematic depicting an exhaust gas treatment system including a burner constructed in accordance with the teachings of the present disclosure.

FIG. 1 depicts an exemplary diesel exhaust gas aftertreatment system 10 for treating the exhaust from a diesel compression engine 16. The exhaust may contain oxides of nitrogen ($NO_x$) such as nitric oxide (NO) and nitrogen dioxide ($NO_2$) among others, particular matter (PM), hydrocarbons, carbon monoxide (CO), and other combustion byproducts.

Aftertreatment system 10 includes a burner 18 that selectively increases the temperature of the exhaust by selectively igniting and combusting fuel to provide the exhaust at an elevated temperature to the rest of the system 10 provides a number of advantages, some of which will be discussed in more detail below.

Aftertreatment system 10 may also include one or more other exhaust treatment devices, such as a diesel particulate filter (DPF) 20 connected downstream from the burner 18 to receive the exhaust therefrom, and a $NO_x$ reducing device 22, such as a selective catalytic reduction catalyst (SCR) or a lean $NO_x$ trap connected downstream from the DPF 20 to receive the exhaust therefrom.

Burner 18 is operable to increase the temperature of the engine exhaust, by employing an active regeneration process for the DPF 20 wherein fuel is ignited in the burner 18 to create a flame that heats the exhaust to an elevated temperature that will allow for oxidation of the PM in the DPF 20. Additionally, in connection with such active regeneration, or independent thereof, burner 18 may be used in a similar manner to heat the exhaust to an elevated temperature that will enhance the conversion efficiency of the $NO_x$ reducing device 22, particularly an SCR. Advantageously, burner 18 may provide elevated exhaust temperatures, either selectively or continuously, independent of a particular engine operating condition, including operating conditions that produce a low temperature (<300° C.) exhaust as it exits engine 16. Thus, aftertreatment system 10 can be operated without requiring adjustments to the engine controls.

Figure 2:
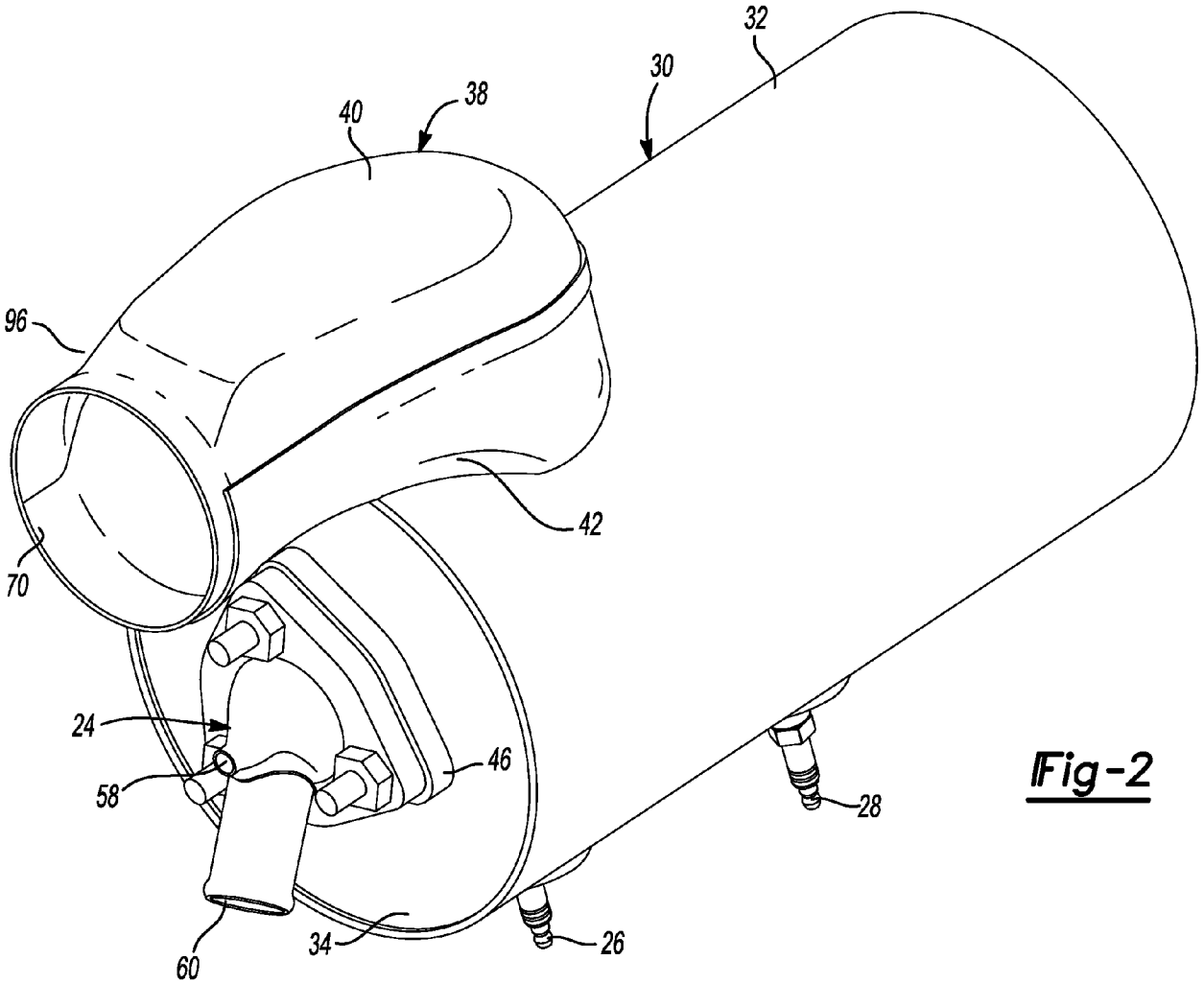
FIG. 2 is a perspective view of the burner.

Burner 18 includes an injector 24 for injecting a suitable fuel and an oxygenator. The fuel may include hydrogen or a hydrocarbon. Injector 24 may be structured as a combined injector that injects both the fuel and oxygenator, as shown in FIG. 2, or may include separate injectors for the fuel and the oxygenator. Preferably, a control system, shown schematically at 25 in FIG. 1, is provided to monitor and control the flows through the injector 24 and the ignition by the first and second igniters 26, 28 using any suitable processor(s), sensors, flow control valves, electric coils, etc.

As shown in FIGS. 2-6, burner 18 includes a housing 30 constructed as a multi-piece assembly of fabricated sheet metal components. Housing 30 includes a cylindrically-shaped body 32, an inlet header 34 and a mixing plate 36. Inlet header 34 is fixed to body 32 and encloses one end of tubular body 32. Mixing plate 36 is positioned within cylindrical body 32 and fixed at an opposite end of the body. Housing 30 also includes an inlet assembly 38. Inlet assembly 38 includes an upper shell 40 fixed to a lower shell 42. Lower shell 42 is fixed to body 32. First shell 40 is shown fixed to second shell 42 at a seam 44. It should be appreciated that inlet assembly 38 may be constructed in this manner to simplify the manufacture of first shell 40 and second shell 42 as stampings from sheets of metal. Other single or multi-piece inlet assemblies are also contemplated as being within the scope of the present disclosure.

A conduit 41 is positioned within housing 30 and includes an open first end 43 extending through an aperture 45 of inlet header 34. An opposite second end 47 of conduit 41 may be fixed to mixing plate 36. Alternatively, second end 47 may be unsupported. An annular volume 49 exists in the space between an inner surface 55 of housing 30 and an outer surface of conduit 41.

An injector mount 46 is fixed to inlet header 34 to provide an attachment mechanism for injector 24. A nozzle portion 52 of injector 24 extends into conduit 41 such that atomized fuel may be injected within a primary combustion chamber 54 at least partially defined by an inner cylindrical surface 57 of conduit 41. Injector 24 includes a fuel inlet 58 and an air inlet 60. When burner operation is desired, fuel is injected via fuel inlet 58 and the oxygenator is provided via air inlet 60 to inject a stream of atomized fuel. First igniter 26 is positioned downstream of inlet header 34 and is operable to combust the fuel provided by injector 24 within primary combustion chamber 54. Volume 49 is placed in fluid communication with a secondary combustion chamber 61 via a plurality of apertures 62 extending through conduit 41.

Inlet assembly 38 includes an inlet opening 70 in receipt of exhaust supplied from engine 16. Inlet assembly 38 also includes an outlet 72 in fluid communication with an aperture 74 extending through body 32. Exhaust provided from engine 16 enters inlet opening 70, travels through inlet assembly 38, exits outlet 72 and enters annular volume 49. Some of the exhaust passes through apertures 62 and enters secondary combustion chamber 61. When burner 18 is operating, the exhaust travelling through apertures 62 will be heated by the flame produced via ignition of the fuel input by injector 24. Additional unburned fuel may be present in the exhaust flowing inlet assembly 38. The unburned fuel may be ignited within secondary combustion chamber 61 by second igniter 28.

Inlet assembly 38 is sized and shaped to accept a flow of engine exhaust initially extending along an axis identified at reference numeral 86. Exhaust travels through inlet assembly 38, body 32 and exits at an outlet 88 travelling along an axis identified at reference numeral 90. Axis 86 and axis 90 extend substantially parallel to and offset from one another. This relative positioning is dictated by the other components within a vehicle equipped with exhaust gas aftertreatment system 10. In particular, the position of inlet opening 70 and the position of outlet 88 are defined by the position and volume of other vehicle components.

To accommodate the manufacturer's request, inlet assembly 38 is designed to turn the exhaust flow substantially 90 degrees from axis 86 to enter aperture 74 of body 32. Inlet assembly 38 is configured in such a manner to minimize back pressure across burner 18. To achieve these goals, inlet opening 70 includes a substantially circular shape having a first diameter and a lip 94. Inlet assembly 38, as defined by first shell 40 and second shell 42, includes a reduced diameter neck portion 96 downstream from lip 94. Further downstream, first shell 40 includes a radially outwardly extending wall portion 98 intersecting with a radially inwardly tapering wall portion 100 at an inflection point 102. Second shell 42 includes a radially inwardly extending wall portion 104 extending from lip 94 to an inflection point 106 where a wall 108 of second shell 42 is closest to axis 86. An indentation 110, including or adjacent to inflection point 106, is formed to complementarily receive a substantially cylindrically shaped portion of body 32.

Figure 4:
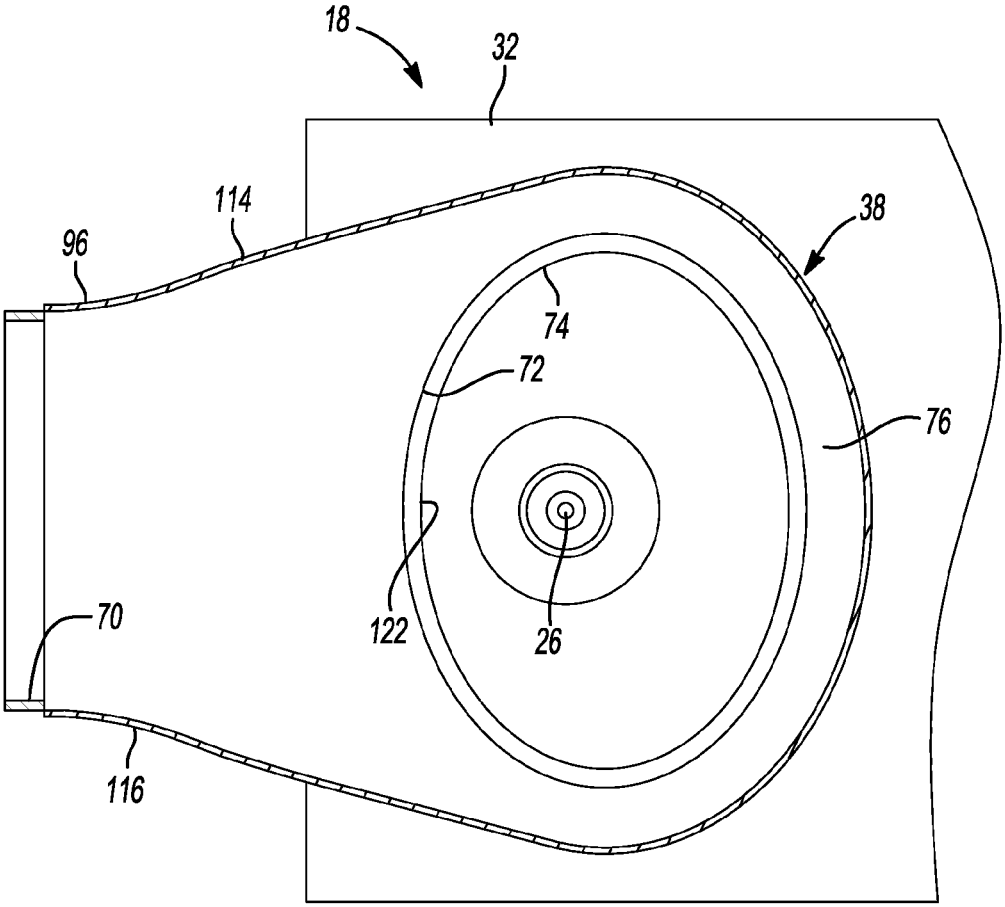
FIG. 4 is a fragmentary top view of the burner with a portion of an inlet housing removed.
Figure 5:
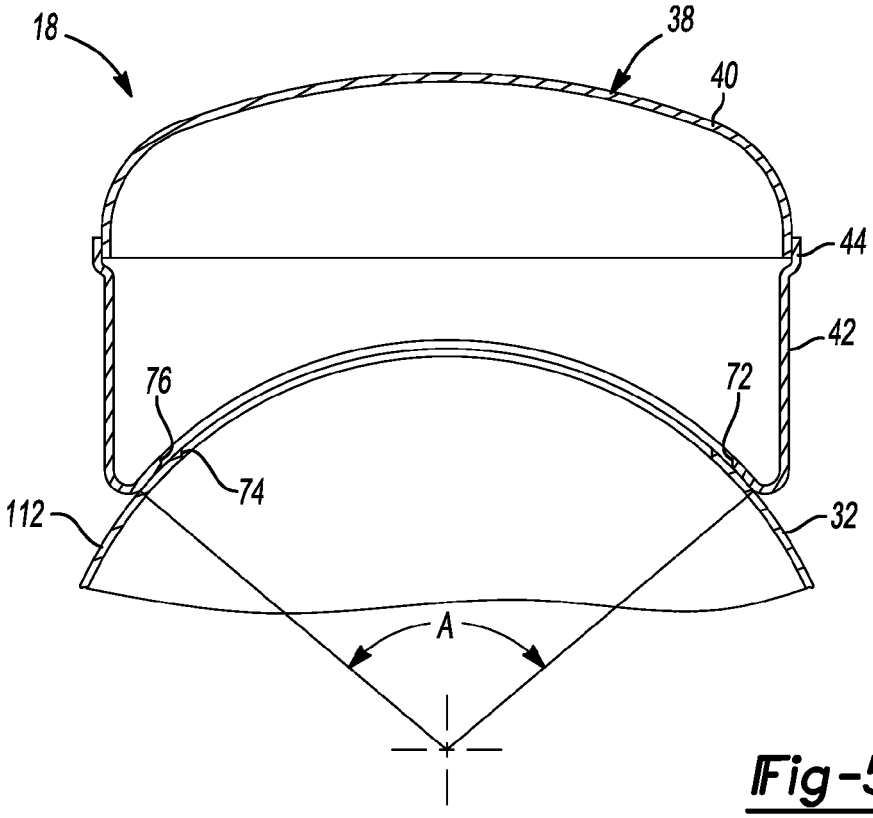
FIG. 5 is a cross-sectional view of the burner.
Figure 6:
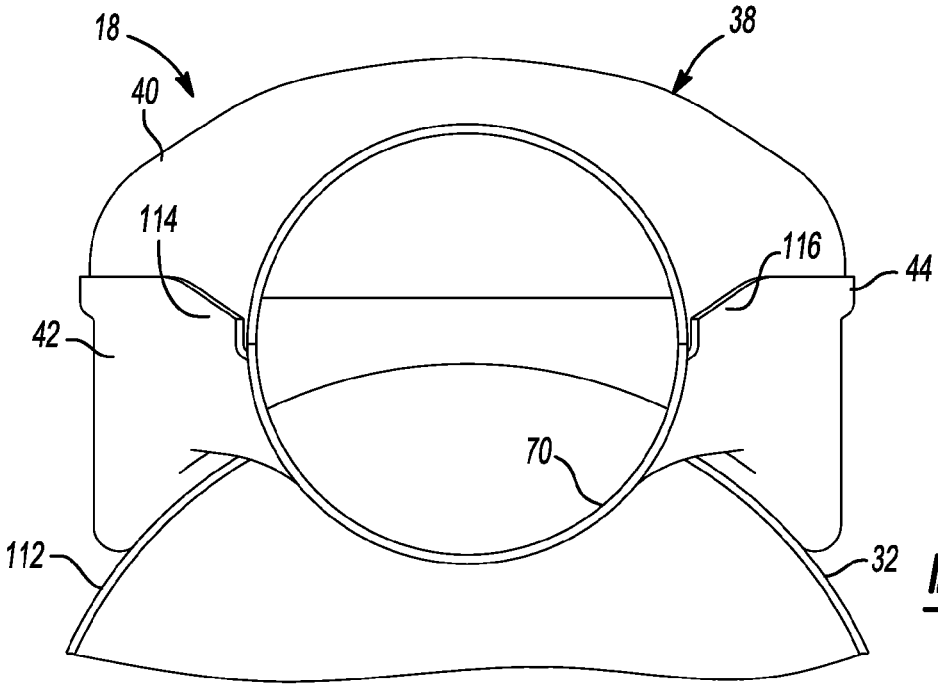
FIG. 6 is a fragmentary end view of the burner.

As best shown in FIG. 4, aperture 74 includes a substantially elliptical shape. Outlet 72 formed in second shell 42 includes a slightly larger but substantially similar elliptical shape. Second shell 42 includes a land 76 surrounding aperture 74. As shown in FIG. 5, land 76 conforms to the cylindrical shape of body 32. Inlet assembly 38 circumferentially extends around an outer surface 112 of body 32 approximately 105 degrees as depicted by angle A. Angle A may range from 85 to 160 degrees without departing from the scope of the present disclosure.

Inlet assembly 38 may be securely fixed to body 32 via a process such as welding at the interface between land 76 and body 32. Inlet assembly 38 conforms to the shape of body 32 to minimize the packaging space required for burner 18 while changing the direction of the exhaust flow into annular volume 49 and secondary combustion chamber 61 to provide optimal burner performance.

FIG. 4 shows side wall portions 114, 116 laterally outwardly extending from neck portion 96. Side wall portions 114, 116 diverge at an angle of substantially 30 degrees. The shape of walls 114, 116 allows exhaust passing through inlet opening 70 to disperse around aperture 74 to provide an even distribution of exhaust flow into secondary combustion chamber 61 while minimizing back pressure. Hot spots within the burner are avoided and optimal combustion performance is promoted within burner 18. For example, the relative position and shape of inlet assembly 38 to injector 24 and conduit 41 defines a properly shaped and sized flame within secondary combustion chamber 61.

Figure 3:
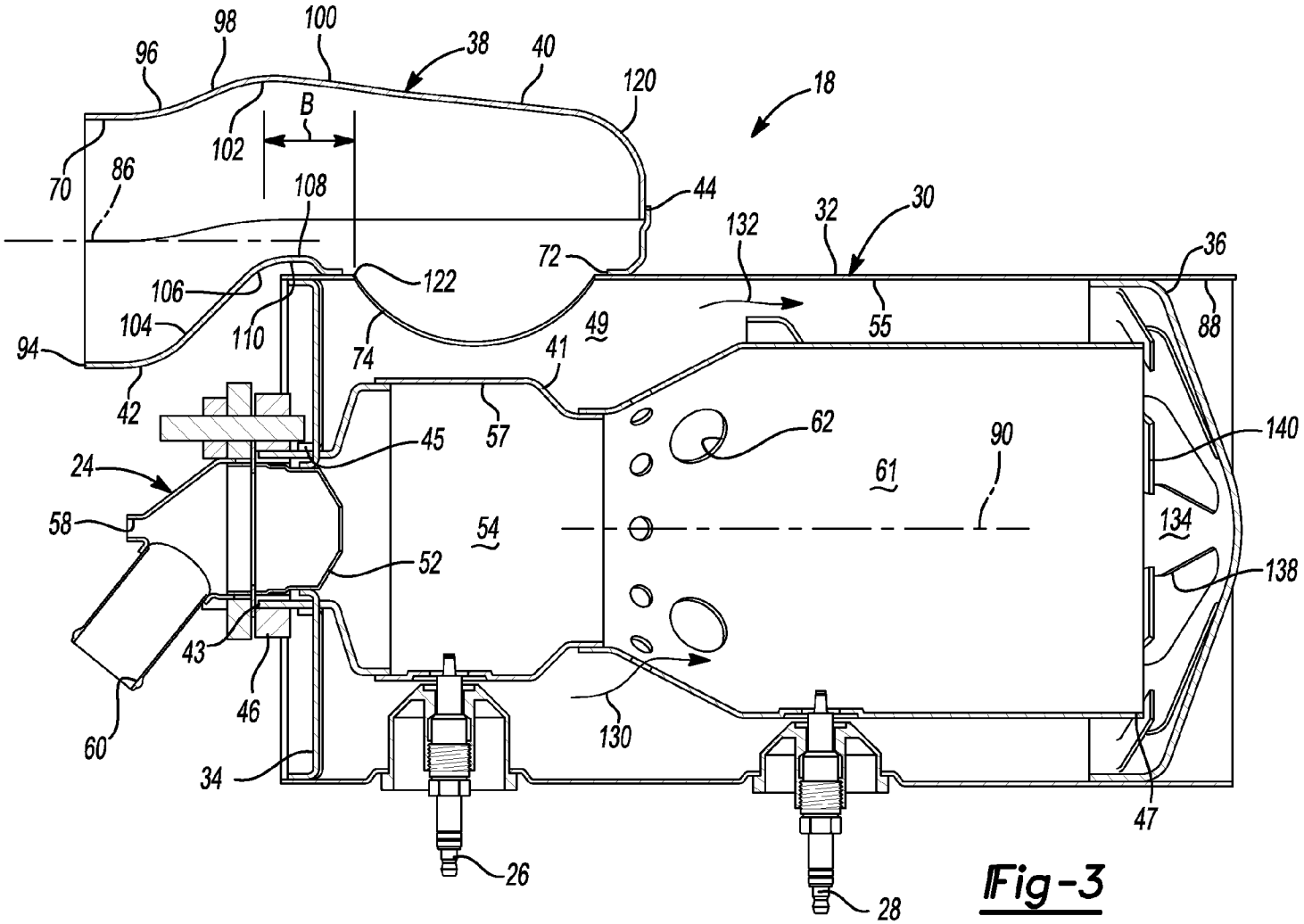
FIG. 3 is a cross-sectional view of the burner depicted in FIG. 1.

To further assist a smooth flow from inlet opening 70 to outlet 72, inflection points 102 and 106 are substantially aligned with one another in that both points are substantially the same distance downstream from lip 94 (FIG. 3). The inflections points are positioned upstream from aperture 74 to assure that the exhaust flow is turned from axis 86 to enter aperture 74 at an angle extending substantially 45 to 90 degrees to axis 86. First shell 40 includes a dome shaped rear wall portion 120 to assist with the re-direction of exhaust flow. In particular, the domed shape of wall portion 120 provides for a flow re-direction into burner aperture 74. More particularly, the shape of the walls of inlet assembly 38 allow for gas to disperse around the inner wall of the stampings before it enters burner aperture 74. By dispersing the gas, a restriction to gas flow is avoided. Back pressure increase is minimized. At the most downstream extent of inlet assembly 38, land 76 is angled to urge exhaust gas into aperture 74.

The axial position of inflection points 102, 106 relative to a leading edge 122 of aperture 74 is optimized to cause exhaust flow to turn into annular volume 49 and secondary combustion chamber 61 while minimizing back pressure. In particular, inflection points 102, 106 are spaced from leading edge 122 a distance identified as distance "B". To achieve the turning function while minimizing back pressure, distance B ranges from 15 to 55 percent of a minor axis dimension of aperture 74.

The shape and relative positioning of the inlet assembly 38, body 32 and conduit 41 define engine exhaust paths that split and recombine with one another. More particularly, exhaust gas from internal combustion engine 16 is provided to inlet opening 70. Exhaust flows from left to right when viewing FIG. 2. As the exhaust continues to flow through outlet 72 and aperture 74, the exhaust passes through annular volume 49 defined between the outer surfaces of conduit 41 and inner surface 55 of body 32. The exhaust flow serves to cool conduit 41 as well as inlet header 34 and body 32. As the exhaust flows, a portion of the engine exhaust travels along a combustion flow path 130. Exhaust travelling along combustion flow path 130 flows through apertures 62. During burner operation, fuel and oxygenator are supplied to primary combustion chamber 54 by injector 24. First igniter 26 produces a flame within primary combustion chamber 54. Exhaust travelling along combustion flow path 130 is heated by the flame and unburned fuel carried in the exhaust may be ignited by the flame and/or second igniter 28 within secondary combustion chamber 61.

The remaining portion of exhaust gas that does not pass through apertures 62 may be characterized as travelling along a bypass flow path 132. Exhaust flows through the volume 49 between conduit 41 and body 32 downstream of apertures 62. The exhaust flowing through bypass flow path 132 cools conduit 41 and body 32 and is supplied to a mixing zone 134 for combination with the combustion flow exiting combustion flow path 130.

Mixing plate 36 extends across bypass flow path 132 to restrict an available flow area of the bypass flow path 132. A plurality of elongated apertures 138 extend through mixing plate 36 to define outlet 88. Outlet 88 is coaxially arranged with axis 90. Mixing plate 36 may be fixed to interior surface 55 of housing 30. Mixing plate 36 may include a plurality of fingers 140 to enhance turbulence and temperature distribution.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exhaust gas treatment device for treating an exhaust flow from an engine, the exhaust gas treatment device comprising:

an inlet housing having an inlet opening for receipt of the exhaust flow from the engine, the inlet opening being aligned along a first axis;

a main housing including a cylindrical body portion defining a treatment zone and an exhaust outlet aligned along a second axis extending parallel to the first axis, the inlet housing being in fluid communication with and fixed to an outer surface of the main housing, the inlet housing including a contoured wall including an end portion positioned opposite the inlet opening, an aperture extending through the wall transverse to the first axis, divergent side wall portions on opposite sides of the inlet opening, and a necked portion having a reduced cross-section positioned downstream of the inlet opening and upstream of the aperture; and a component coupled to the main housing for treating exhaust flowing through the treatment zone.

2. The exhaust gas treatment device of claim 1 wherein the inlet housing includes first and second stamped steel shells fixed to one another along a peripheral seam.

3. The exhaust gas treatment device of claim 1 wherein the aperture includes an elongated shape.

4. The exhaust gas treatment device of claim 3 wherein the component includes an injector to inject fuel into the treatment zone.

5. The exhaust gas treatment device of claim 4 further including an igniter to combust the fuel in the treatment zone.

6. The exhaust gas treatment device of claim 5 wherein the main housing includes an inlet header fixed to the cylindrical body portion to close one end of the main housing, the injector being mounted to the inlet header to inject fuel along the second axis.

7. The exhaust gas treatment device of claim 6 wherein a portion of the contoured wall opposite the aperture includes a radially outwardly sloping portion intersecting a radially inwardly sloping portion at an inflection point, the inflection point being positioned axially downstream from the inlet opening and upstream from an upstream edge of the aperture to redirect the exhaust flow through the aperture.

8. The exhaust gas treatment device of claim 7 wherein the inflection point is spaced from the upstream edge of the aperture a distance ranging from 15 to 55 percent of a minor axis dimension of the aperture.

9. The exhaust gas treatment device of claim 8 further including another igniter coupled to the main housing and positioned downstream of the igniter to combust unburned fuel in the exhaust flowing through the inlet housing.

10. An exhaust gas treatment device for treating an exhaust flow from an engine, the exhaust gas treatment device comprising:

an inlet housing having an inlet opening for receipt of the exhaust flow from the engine, the inlet opening being aligned along a first axis;

a main housing including a cylindrical body portion defining a treatment zone and an exhaust outlet aligned along a second axis extending parallel to the first axis, the inlet housing being in fluid communication with and fixed to an outer surface of the main housing, the inlet housing including a contoured wall including an end portion positioned opposite the inlet opening and an aperture extending through the wall transverse to the first axis, wherein a portion of the contoured wall opposite the aperture includes a radially outwardly sloping portion intersecting a radially inwardly sloping portion at an inflection point, the inflection point being positioned axially downstream from the inlet opening and upstream from an upstream edge of the aperture to redirect the exhaust flow through the aperture; and a component coupled to the main housing for treating exhaust flowing through the treatment zone.

11. The exhaust gas treatment device of claim 10 wherein the inflection point is spaced from the upstream edge of the aperture a distance ranging from 15 to 55 percent of a minor axis dimension of the aperture.

12. The exhaust gas treatment device of claim 10 further including a mixer plate fixed to the body portion for mixing the gases exiting the exhaust treatment device.

13. The exhaust gas treatment device of claim 10 wherein the component includes an injector to inject fuel into the treatment zone.

14. The exhaust gas treatment device of claim 13 further including an igniter to combust the fuel in the treatment zone.

15. The exhaust gas treatment device of claim 14 wherein the main housing includes an inlet header fixed to the cylindrical body portion to close one end of the main housing, the injector being mounted to the inlet header to inject fuel along the second axis.

16. The exhaust gas treatment device of claim 15 wherein the aperture includes an elongated shape.

17. The exhaust gas treatment device of claim 16 further including another igniter coupled to the main housing and positioned downstream of the igniter to combust unburned fuel in the exhaust flowing through the inlet housing.

18. The exhaust gas treatment system of claim 13 further including a conduit positioned within the main housing, the injector injecting fuel within the conduit, the exhaust passing through the inlet housing being split into a combustion portion that passes through apertures extending through the conduit and a bypass portion flowing between the main housing and the conduit.

* * * * *